United States Patent [19]

Erlich

[11] Patent Number: 4,984,924

[45] Date of Patent: Jan. 15, 1991

[54] LOOSE LEAF HOLDER

[76] Inventor: Moshe Erlich, 66 Shai Agnon Street, Herzliya, Israel

[21] Appl. No.: 273,025

[22] Filed: Nov. 18, 1988

[30] Foreign Application Priority Data

Nov. 23, 1987 [IL] Israel ..... 84573

[51] Int. Cl.[5] ..... B42F 3/00

[52] U.S. Cl. ..... 402/4; 402/79; 402/80 R; 402/501

[58] Field of Search ..... 402/4, 79, 80 R, 80 L, 402/80 P, 501

[56] References Cited

U.S. PATENT DOCUMENTS

| | | | |
|---|---|---|---|
| 2,731,017 | 1/1956 | Neilsen | 402/501 X |
| 3,503,695 | 3/1970 | Giampa | 402/80 R X |
| 4,403,883 | 9/1983 | Sorin | 402/79 |
| 4,430,015 | 6/1981 | Nerlinger . | |
| 4,516,871 | 7/1982 | Leitman . | |
| 4,614,450 | 9/1986 | Neiman | 402/80 P X |
| 4,636,119 | 1/1987 | Gentile et al. | 402/80 R X |
| 4,723,861 | 2/1988 | Merchant | 402/79 X |
| 4,811,973 | 3/1989 | Kumar-Misir | 402/79 X |

FOREIGN PATENT DOCUMENTS

| | | | |
|---|---|---|---|
| 247831 | 6/1966 | Austria | 402/4 |
| 889741 | 9/1953 | Fed. Rep. of Germany | 402/4 |
| 2042442 | 3/1972 | Fed. Rep. of Germany | 402/4 |
| 2570790 | 9/1975 | Fed. Rep. of Germany | 402/4 |
| 488573 | 8/1968 | Switzerland . | |
| 222706 | 10/1924 | United Kingdom | 402/501 |
| 1280156 | 7/1969 | United Kingdom . | |

*Primary Examiner*—Paul A. Bell

*Attorney, Agent, or Firm*—Nixon & Vanderhye

[57] ABSTRACT

For detachable mounting onto a storage system including a pair of rodlike mounting elements mounted onto a common base and lying along an axis, a loose leaf holder comprising a planar member and apparatus associated with an edge of the planar member for detachably mounting the planar member onto the rodlike mounting elements by applying to the planar member a force having a component at right angles to the axis.

12 Claims, 3 Drawing Sheets

LOOSE LEAF HOLDER

FIELD OF THE INVENTION

The present invention relates generally to loose leaf storage system, and particularly to a detachable loose leaf holder for use therewith.

BACKGROUND OF THE INVENTION

There is available on the market a wide variety of loose leaf holders by which standard size documents may be retained for storage. A conventional loose leaf holder comprises a pair of lockable flexible elements that are mounted on a common base and upon which one or more leaves may be mounted, by means of holes punched along an edge of the one or more leaves.

Also available are loose leaf holders having a planar base configured for retention by a ring binder, which generally comprises a pair of lockable, rigid, metal ring-shaped elements mounted on a base. Ring binder retainable holders are particularly useful for storing a number of sets of documents that it is wished to keep separate, and which it may be useful to remove individually from the ring binder.

There is further available a detachable ring binder retainable holder wherein a planar base is mountable onto a ring binder by means of a pair of L-shaped grooves configured for engagement with the ring-shaped elements of the ring binder. A leaf spring is also provided inside each groove, which prevents the holder from becoming accidentally detached from the ring binder.

Among disadvantages of the detachable holder described above is that the mounting thereof onto a ring binder, and the detachment thereof from a ring binder, may be achieved only by a series of relatively complex movements of the detachable holder and the ring binder relative to each other.

SUMMARY OF THE INVENTION

It is an aim of the present invention to provide a loose leaf holder for removable mounting on storage apparatus, the holder being configured for convenient mounting onto the storage apparatus and removal from the storage apparatus by gripping the holder and respectively pushing it onto the storage apparatus and pulling it away from the storage apparatus in a single movement.

There is therefore provided, in accordance with an embodiment of the invention, for detachable mounting onto a storage system including a pair of rodlike mounting elements mounted onto a common base and lying along an axis, a loose leaf holder comprising a planar member and apparatus associated with an edge of the planar member for detachably mounting the planar member onto the rodlike mounting elements by applying to the planar member a force having a component at right angles to the axis.

Additionally in accordance with an embodiment of the invention, the planar member and the apparatus for detachably mounting are formed from a single portion of a flexible, resilient material.

Further in accordance with an embodiment of the invention, the apparatus for detachably mounting comprises a pair of apertures defining edge openings, the openings having a width smaller than the width of the mounting elements and the apertures having a width larger than the width of the mounting elements.

Additionally in accordance with an embodiment of the invention, the loose leaf holder also includes apparatus associated with the planar member for retentively engaging a loose leaf.

Further in accordance with an embodiment of the invention, the planar member, the apparatus for detachably mounting and the apparatus for retentively engaging are formed from a single portion of material.

Additionally in accordance with an embodiment of the invention, the apparatus for retentively engaging comprises a pair of spaced apart flexible mounting members for insertion through holes provided in the loose leaf; and a locking member, formed integrally with the planar member and detachable therefrom, in which there are provided a plurality of holes for threadably receiving the flexible mounting members so as to secure the locking member to the planar member.

Further in accordance with an embodiment of the invention, a plurality of apertures is provided in the planar member adjacent the edge, the plurality of apertures being configured for threaded engagement by a rodlike hanging member used for suspending the holder.

Additionally in accordance with an embodiment of the invention, the holder also includes referencing indicia for selecting out a single holder from a plurality of holders mounted on the storage system.

BRIEF DESCRIPTION OF THE DRAWINGS

The present invention will be understood and appreciated more fully from the following detailed description, taken in conjunction with the drawings, in which.

DETAILED DESCRIPTION OF THE INVENTION

Figure 1:
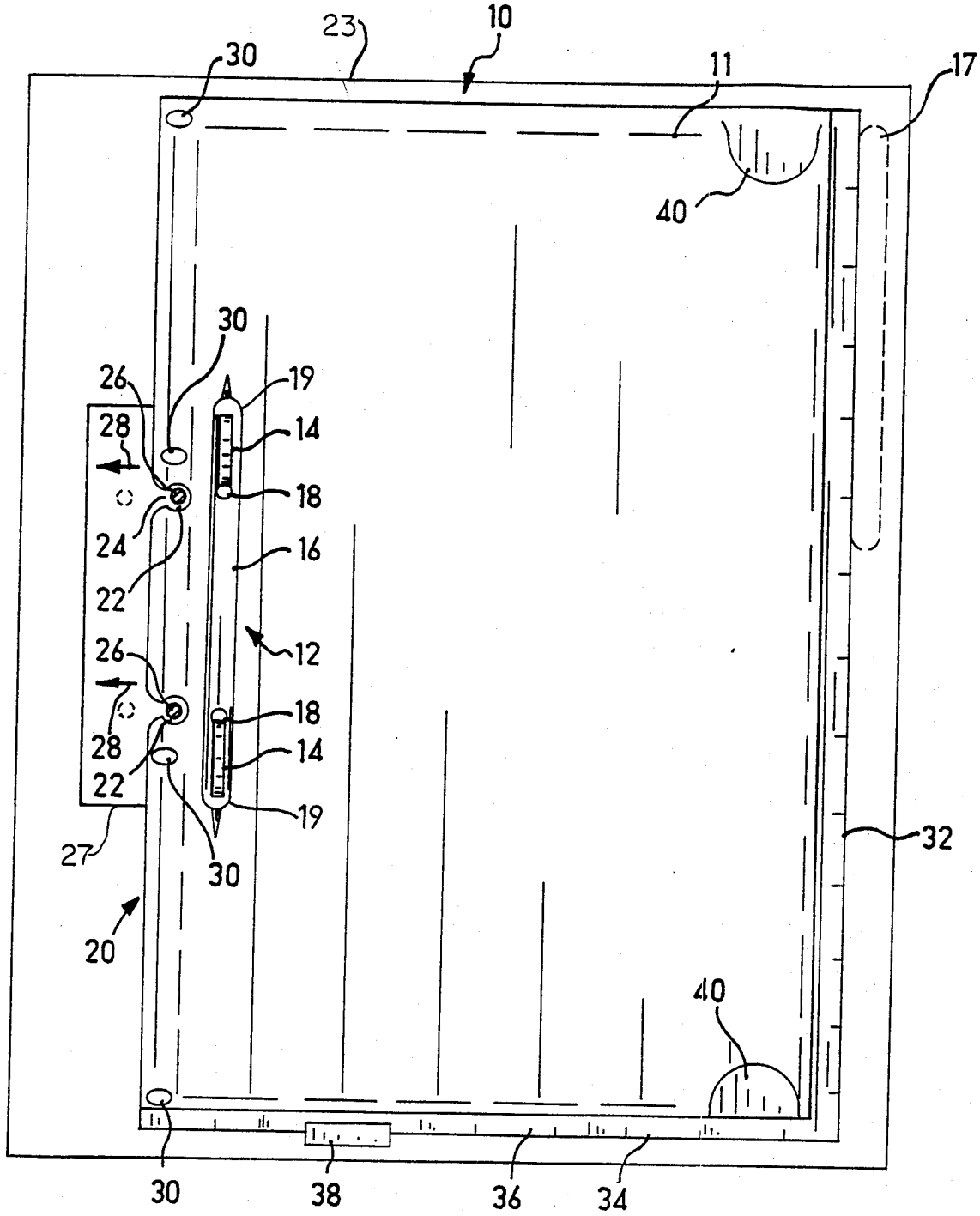
FIG. 1 shows a detachable holder, constructed according to a preferred embodiment of the invention.

Referring to FIG. 1, there is shown, indicated generally by referenced numeral 10, a detachable holder for loose leaves. A loose leaf is indicated by broken lines and is referenced 11. It is an important feature of the invention that, holder 10 is manufactured from a single sheet of material. It is, however, appreciated that the holder may also be manufactured from more than one sheet of material, and that a single, non-integrally formed holder may be formed from more than one material.

Holder 10 defines a planar surface with which there is preferably integrally formed, apparatus 12 for retentively engaging one or more loose leaves. Apparatus 12 comprises typically a pair of flexible elements 14 that are configured for passing through holes in a loose leaf. Apparatus 12 also includes a locking member 16 in which there are formed a pair of apertures 18 which have a similar spacing to that of a loose leaf to be retained by elements 14. In association with each aperture 18 there is also provided an end aperture 19.

Each element 14 cooperates with locking member 16 by being threaded through an adjacent pair of apertures 18 and 19, so as to secure locking member 16 to holder 10 and, therefore, secure a loose leaf mounted onto elements 14.

According to a preferred embodiment of the invention, locking member 16 is integrally formed with holder 10, as shown by broken line 17, and is intended for separation therefrom, as by tearing, after manufacture.

Formed integrally with an edge 20 of holder 10 are a pair of mounting apertures 22, each of which has a relatively small opening 24, relative to the size of the aperture. Apertures 22 are configured for retention by a conventional ring binder 23 or any other suitable storage apparatus.

Openings 24 are provided so as to facilitate mounting of holder 10 onto ring binder members 26 mounted on a common base 27 simply by lining up openings 24 therewith and pushing the holder thereagainst, in a single movement, indicated by arrows 28 and substantially at right angles to an imaginary axis passing through both members 26, such that the larger mounting apertures 22 are formed into engagement with members 26. Detachment of holder 10 is effected simply by pulling the holder away from ring members 26.

Holder 10 is made from material that is sufficiently flexible but resilient material so as to facilitate slight elastic bending of the holder, while not sustaining damage. This bending occurs when mounting apertures 22 are brought into or out of engagement with ring members 26. In accordance with a preferred embodiment of the invention, holder 10 is made from plastic.

Also formed in edge 20 are a plurality of apertures 30 through which a conventional hanger (not shown) may be threaded when it is wished to use holder 10 in a hanging storage or filing system.

Provided along side and bottom edges, referenced 32 and 34, respectively, are referencing scales 36, to which a marker 38 may be attached. This is useful when storing a number of sets of documents in storage apparatus such as a claisseur on which there is mounted a ring binder, wherein each set is stored on a particular holder. It is intended to enable a user to select a particular set of documents by the location of its marker 38 without having to search through all of the sets of documents.

There is also provided apparatus for holding down loose leaves along the opposite edge of holder 10 to edge 20. Shown by reference numeral 40 are a pair of integrally formed flaps, under which a document may be inserted in order to provide retention thereof in addition to that effected by apparatus 12.

Figure 2:
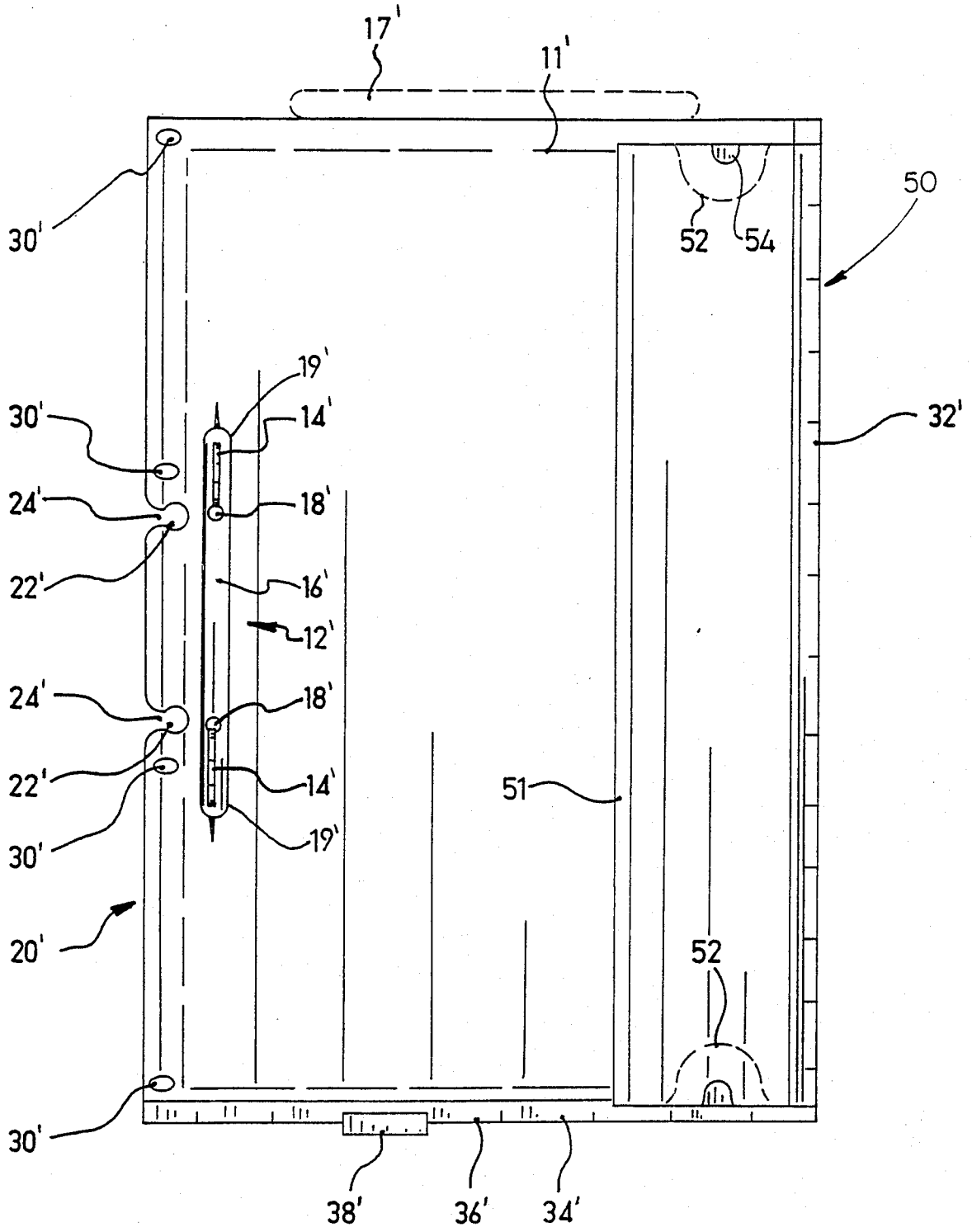
FIG. 2 shows a detachable holder, constructed according to an alternative embodiment of the invention.

With reference now to FIG. 2, there is shown a detachable holder 50 that includes many of the features of holder 10, and which therefore will not be described again in detail like reference numerals being applied in FIG. 2 as in FIG. 1 to denote like parts but followed by the symbol prime (').

Holder 50 is similar to holder 10, but it has additional loose leaf retaining apparatus not included in holder 10. The additional loose leaf retaining apparatus includes a longitudinal flap 51, that may be folded down onto loose leaves retained by apparatus 12' so as to further secure them. There are also provided two locking flaps 52, to hold flap 51 in position once it has been folded down. Each of locking flaps 52 comprises a flap portion 54 that is configured for insertion into a slit (not shown) in longitudinal flap 51, thereby securing it.

Figure 3:
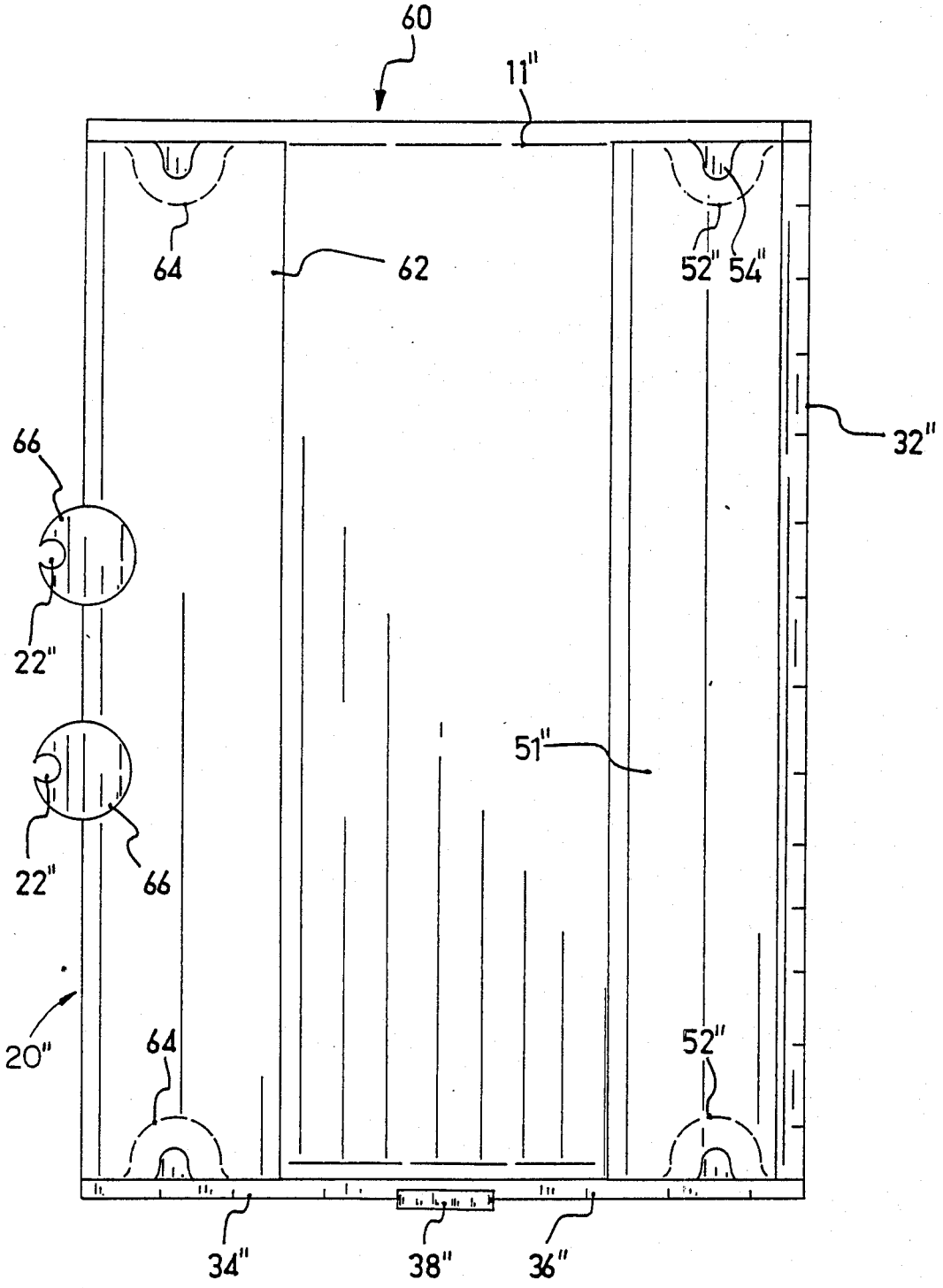
FIG. 3 shows a detachable holder, constructed according to yet a further embodiment of the invention.

With reference now to FIG. 3, there is shown a detachable holder 60 that includes many of the features of holder 50, and which therefore will not be described again in detail like reference numerals being applied in FIG. 3 as in FIG. 2 to denote like parts but followed by the symbol double prime (").

Holder 60 is generally similar to holder 50, but it includes an additional longitudinal flap 62 formed along edge 20" of the holder, that may be folded down onto loose leaves retained by apparatus 12", so as to further secure them. There is also provided an additional pair of locking flaps 64, to hold flap 62 in position once it is folded down. In the shown embodiment, mounting apertures 22" are formed in side protrusions 66, so as not to interfere with flap 62.

In the present embodiment, apparatus 12 need not be provided. Due to the provision of two longitudinal securable flaps 51" and 62, respectively any loose leaves stored by holder 60 are sufficiently well secured so as not to require additional securing by apparatus 12 as described above in conjunction with FIG. 1.

An important feature of the present invention is that each of the holders 10, 50 and 60 and their associated flaps and other appendages, other than marker 38, (FIG. 1) is preferably completely formed from a single sheet of plastic.

It will be appreciated by persons skilled in the art that, the present invention is not limited by what has been shown and described hereinabove. The scope of the invention is, rather, defined solely by the claims, which follow:

I claim:

1. A ring binder assembly comprising:

a ring binder comprising rodlike mounting elements mounted on a common base and lying along a predetermined axis;

a plurality of loose leaf holders, each comprising:

a planar member;

means associated with an edge of said planar member for detachably mounting said planar member onto said mounting elements without requiring opening of said elements by applying to said planar member a force having a component at right angles to said predetermined axis;

means for removably engaging onto said planar member at least one loose leaf having a predetermined configuration with at least two engagement apertures and at least two corners, said means being adapted to engage at least two of the engagement apertures; and corner engaging flaps associated with said planar member for removably engaging onto said planar member at least two corners of a loose leaf.

2. A ring binder assembly according to claim 1 and wherein said corner engaging flaps engage only the corners of said at least one loose leaf.

3. A loose leaf holder for holding at least one loose leaf having a predetermined configuration with at least two engagement apertures and at least two corners.

said holder being adapted for detachable mounting onto a storage system, the storage system including at least two spaced rodlike mounting elements of predetermined width mounted onto a common base and lying along a predetermined axis, said loose lead holder comprising:

a planar member;

means associated with an edge of said planar member for detachably mounting said planar member onto the rodlike mounting elements by applying to said planar member a force having a component at right angles to said predetermined axis;

means for removably engaging the apertures of a loose leaf; and corner engaging flap means associated with said planar member for removably engaging at least two of the corners of a loose leaf.

4. A loose leaf holder according to claim 3, and wherein said planar member and said means for detachably mounting are formed from a single portion of material.

5. A loose leaf holder according to claim 4, and wherein said material is a flexible, resilient material.

6. A loose leaf holder according to claim 5, and wherein said means for detachably mounting comprises at least two apertures defining edge openings, said openings having a width smaller than said predetermined width and apertures having a width larger than said predetermined width.

7. A loose leaf holder according to claim 6, and wherein a plurality of apertures is provided in said planar member adjacent said edge, said plurality of apertures being configured for threaded engagement by a rodlike hanging member used for suspending said holder.

8. A loose leaf holder according to claim 1, and wherein said planar member, said means for detachably mounting and said means for removably engaging are formed from a single portion of material.

9. A loose leaf holder according to claim 8, and wherein said means for removably engaging comprises:

a pair of spaced apart flexible mounting members for insertion through the apertures of a loose leaf; and a locking member, formed integrally with said planar member and detachable therefrom, in which there are provided a plurality of holes for receiving said flexible mounting members so as to secure said locking member to said planar member.

10. A loose leaf holder according to claim 3, and also including referencing indicia for selecting out a single holder from a plurality of said holders mounting on the storage system.

11. A loose leaf holder according to claim 3, and wherein said flap means and at least part of said means for removably engaging are formed integrally with said planar means.

12. A loose leaf holder according to claim 3, and wherein said flap means cover only the corners of a loose leaf.

* * * * *